United States Patent [19]

Tringali et al.

[11] 3,942,421

[45] Mar. 9, 1976

[54] SEAL STRIPS FOR FUME HOODS

[75] Inventors: Richard C. Tringali; Michael Turko, both of Manitowoc, Wis.

[73] Assignee: American Hospital Supply Corporation, Evanston, Ill.

[22] Filed: Nov. 18, 1974

[21] Appl. No.: 524,780

[52] U.S. Cl. ..... 98/115 LH; 160/43

[51] Int. Cl.[2] ..... F23J 11/00

[58] Field of Search ..... 98/115 LH; 160/40, 43; 128/1 B

[56] References Cited

UNITED STATES PATENTS

| | | | |
|---|---|---|---|
| 1,823,237 | 9/1931 | Caesar | 160/43 |
| 2,810,337 | 10/1957 | Samuelson et al. | 98/115 LH |

*Primary Examiner*—William F. O'Dea
*Assistant Examiner*—Ronald C. Capossela

[57] ABSTRACT

A fume hood is provided with seal strips to prevent or inhibit leakage of air through the sash clearance opening at the top of the hood. A front seal is mounted on the rear wall of the auxiliary air chamber and essentially engages the front surface of the sash when the sash is partially or completely raised, and a rear seal is mounted on the front wall of the working chamber and essentially engages the rear surface of the sash when the sash is raised. If desired, either or both of the seals can have a width sufficient to extend all the way across the sash clearance opening when the sash is lowered to seal the sash clearance opening.

17 Claims, 7 Drawing Figures

SEAL STRIPS FOR FUME HOODS

BACKGROUND AND SUMMARY

This invention relates to fume hoods, and more particularly, to fume hoods which are equipped with auxiliary air chambers.

As explained more fully in U.S. Pat. No. 3,747,504, some fume hoods are equipped with auxiliary air chambers in order to decrease the amount of conditioned room air that is exhausted through the fume hood. Auxiliary air systems conventionally supply about 75% of the air which is exhausted by the fume hood, and the remaining 25% is drawn from the laboratory room to prevent fume counterflows from entering the room.

Most fume hoods include a sash which may be raised or lowered to close the working chamber of the hood. The top of the hood is provided with a clearance to permit the sash to be raised, and this opening presents a possibility of air leakage.

Further, we have found that fumes from within the hood may cling to the rear surface of the sash or may be carried or drawn upwardly by the sash as it is raised. As these fumes move upwardly through the sash clearance opening, they can escape into the laboratory.

The invention utilizes a pair of seals to prevent or inhibit air leakage through the sash clearance opening, and the rear seal also wipes the sash clean of any clinging fumes as it is raised, resulting in greater safety and efficiency. Auxiliary air which otherwise might escape through the opening is routed through the hood. When the sash is raised, the rear or upper seal contacts the rear surface of the glass. The seals may be provided in such sizes that when the sash is lowered the rear seal will contact the rear wall of the auxiliary air chamber and the front seal will contact the front wall of the working chamber. The rear seal will thereby prevent room air from entering the working chamber when the sash is raised, partially lowered, and completely lowered and will wipe the sash of clinging fumes as the sash is raised. The front seal will prevent loss of auxiliary air through the sash clearance opening when the sash is raised, partially lowered, and completely lowered.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
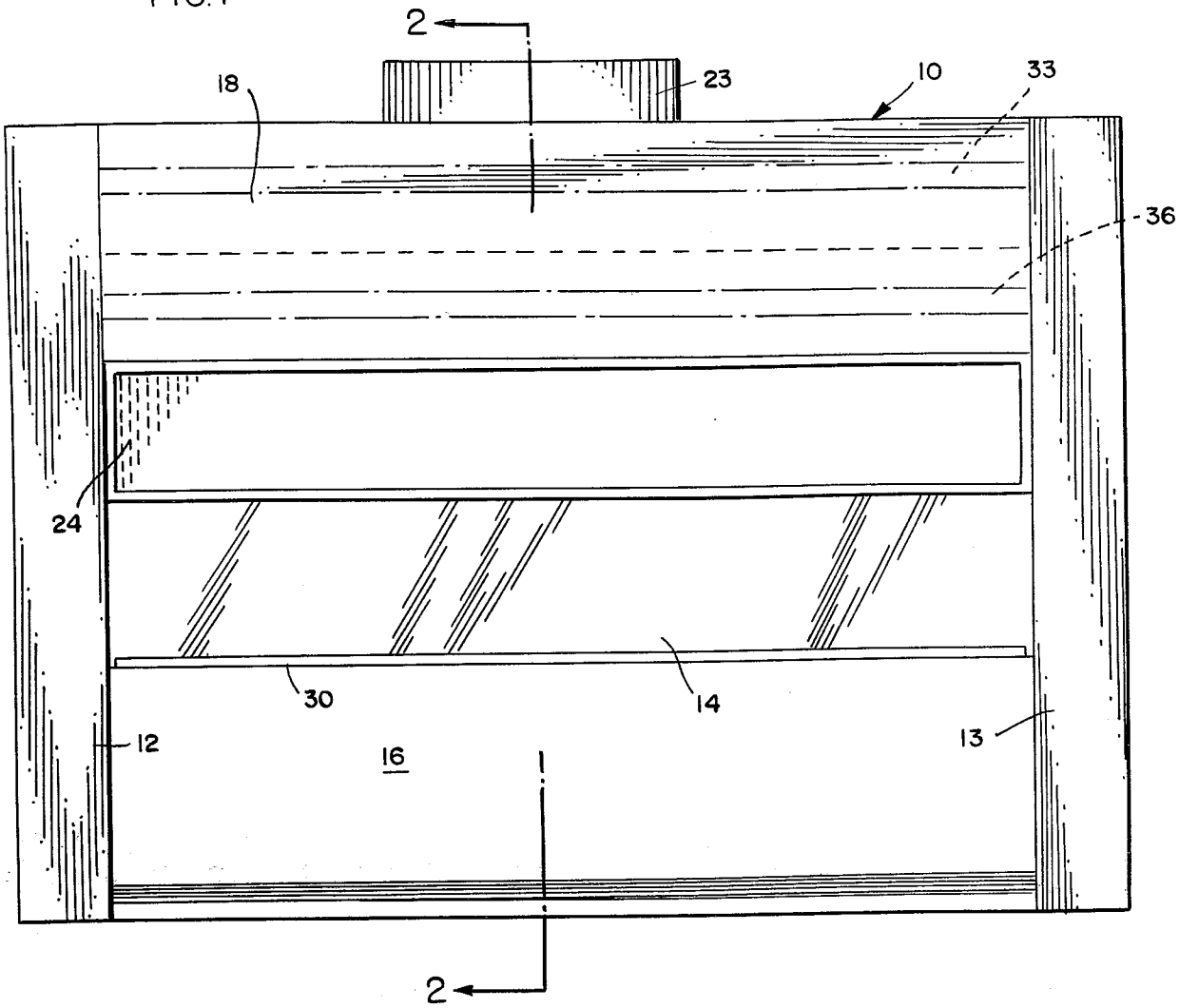
FIG. 1 is a front elevational view of a fume hood equipped with one embodiment of seals in accordance with the invention, showing the sash partially raised.
Figure 2:
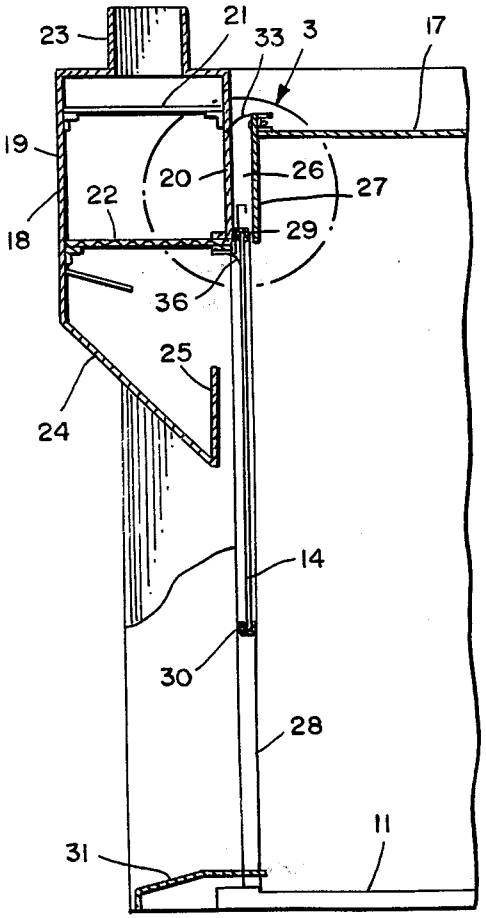
FIG. 2 is a sectional view taken along the line 2—2 of FIG. 1.

Referring first to FIGS. 1 and 2, the numeral 10 designates generally a fume hood of the type described in U.S. Pat. No. 3,747,504, to which reference may be had for details. The fume hood includes a work surface 11, a pair of side walls 12 and 13, and a sash 14 which is slidably mounted in channels or tracks in the side walls.

An auxiliary air chamber 18 is mounted on the front of the fume hood and includes front and rear walls 19 and 20, an air diffuser 21, and an air grille 22. Auxiliary air is forced through an air inlet 23 by an air blower (not shown) and leaves the auxiliary air chamber through a directional air grille 24. An air dividing plate 25 extends upwardly behind the grille 24.

The sash 14 is movable within a sash clearance opening 26 which is provided between the rear wall 20 of the auxiliary air chamber and a front wall 27 of the fume hood which extends downwardly from the top wall 17. The sash is slidably mounted in channels 28 secured to the side walls 12 and 13, and the upper and lower edges of the sash glass are covered by upper and lower sash channels or frame members 29 and 30, respectively. The sash is movable between a fully lowered position in which the lower sash channel 30 contacts the foil 31 and a fully raised position in which the lower edge of the sash is adjacent the bottom of the auxiliary air chamber.

Figure 3:
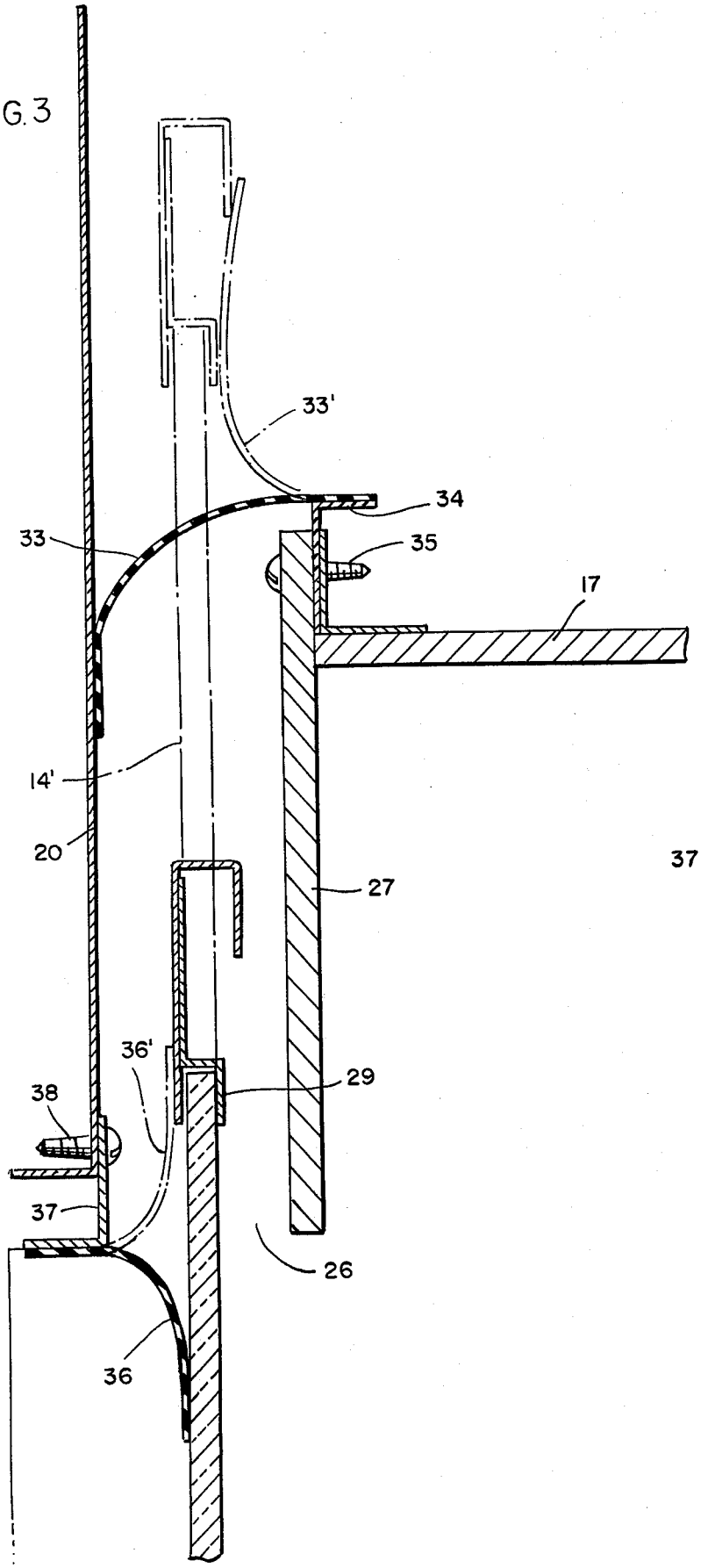
FIG. 3 is an enlarged fragmentary sectional view similar to FIG. 2 and also showing the sash in a slightly higher position in dotted outline.

Referring now to FIG. 3, an upper or rear seal 33 is secured to an angle 34 attached to the front wall 27 by screw 35 and extends across the sash clearance opening to the rear wall 20 of the auxiliary air chamber when the sash is below the upper seal as illustrated in solid outline in FIG. 3. The seal extends for the full length of the sash clearance opening between the channels 28 in which the sash slides, and the width of the seal is such that a substantial end portion sealingly contacts the wall 20. The seal is formed of suitable flexible and resilient material, and in one specific embodiment a chemical resistant tape made of neoprene and a woven fiberglas base sold under the name "Clairtex" was used. This tape was cemented to the support angle 34 by a fast-drying cement sold under the name "Locktite 404."

Figure 4:
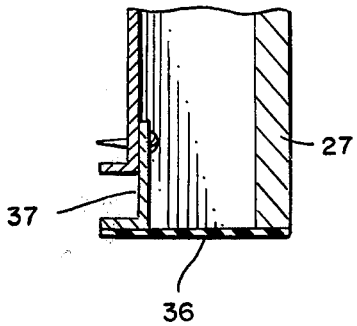
FIG. 4 is a fragmentary sectional view showing the lower seal when the sash is fully lowered.

A lower or front seal 36, also made of flexible and resilient material, is secured to a mounting angle 37 which is attached to the auxiliary air chamber by screw 38. The width of the seal 36 is such that the seal extends across the sash clearance opening and sealingly engages the lower edge of the wall 27 when the upper edge of the sash moves below the lower seal as shown in FIG. 4. The seal 36 also extends along the full length of the sash clearance opening between the channels 28.

When the sash is raised beyond the rear seal as indicated in dotted outline at 14' in FIG. 3, the rear seal sealingly engages the rear surface of the sash as indicated at 33', and the lower or front seal sealingly engages the front surface of the sash as indicated at 36'. The air inside the working chamber of the hood is at negative pressure relative to the auxiliary air chamber and the laboratory room, and the upper seal prevents room air from entering the working chamber through the sash clearance opening at the roof of the hood. The lower seal prevents leakage of auxiliary air, which is at positive pressure, up through the space between the sash and the auxiliary air chamber and into the laboratory room.

The rear seal also performs another, perhaps more important function. We have observed that fumes inside the working chamber sometimes cling to the rear surface of the sash. These fumes may be carried upwardly by the sash as it is raised, or the upwardly moving sash may create air currents that will cause fumes to move upwardly toward the sash clearance opening at the roof of the fume hood. If the fumes are carried through the sash clearance opening, they can escape into the laboratory. The rear seal wipes the rear surface of the sash free of clinging fumes as the sash is raised and prevents fumes from passing through the sash clearance opening.

As the sash is lowered, the friction between the seals and the sash and the edge mount 29 causes the seals to flex toward the direction of sash movement and reverse themselves. Thus, the lower seal flexes from the position illustrated in dotted outline to the position illustrated in solid in FIG. 3 as the sash is moved to the partially raised position illustrated in solid. The curvature of the upper seal 33 is also reversed, and as the sash passes below the upper seal, the upper seal flexes upwardly to sealingly engage the rear wall of the auxiliary air chamber as shown in solid in FIG. 3.

When the sash is in the partially lowered position indicated in solid outline in FIG. 3, the upper seal completely seals the sash clearance opening and prevents room air from entering. The lower seal contacts the front of the sash and prevents auxiliary air from short circuiting over the upper edge of the sash into the working chamber.

When the upper edge of the sash moves below the lower seal, the lower seal flexes upwardly into sealing contact with the lower edge of the wall 27 as shown in FIG. 4. In the fully lowered position of the sash, both of the seals prevent room air from entering the hood through the sash clearance opening at the roof of the hood.

When the sash is raised, it contacts first the lower seal and then the upper seal, and loss of auxiliary air or entry of room air through the sash clearance opening at the roof of the hood is prevented at all times.

The resilience of the seals is such that the seals prevent passage of auxiliary air and room air even when they are flexed toward the direction in which the air force is exerted on them. For example, when the upper seal is in the solid position of FIG. 3 and the lower seal is in the dotted position, room air and auxiliary air, respectively, exert a force on the upper and lower seals in the same direction as the curvature of the seals. However, the upper seal remains in sealing contact with the auxiliary air chamber and the lower seal remains in sealing contact with the sash to prevent passage of air.

Figure 5:
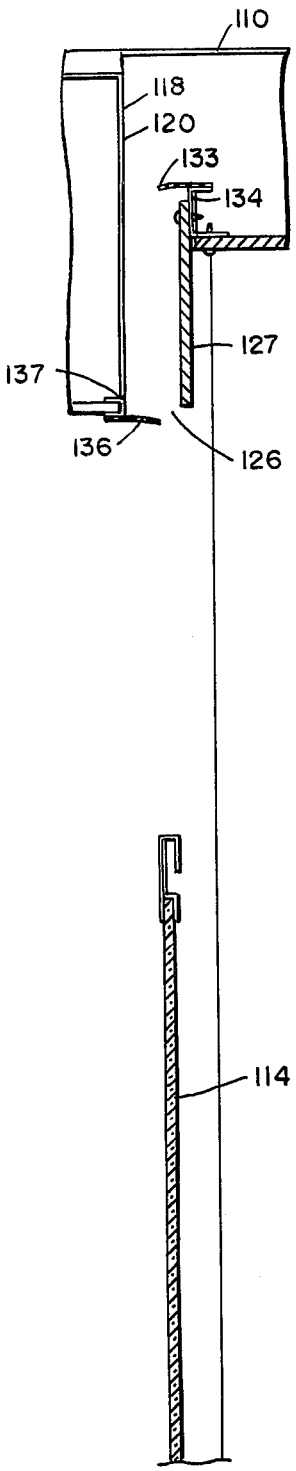
FIG. 5 is a view similar to FIG. 3 showing another embodiment of seals and the sash fully lowered.
Figure 6:
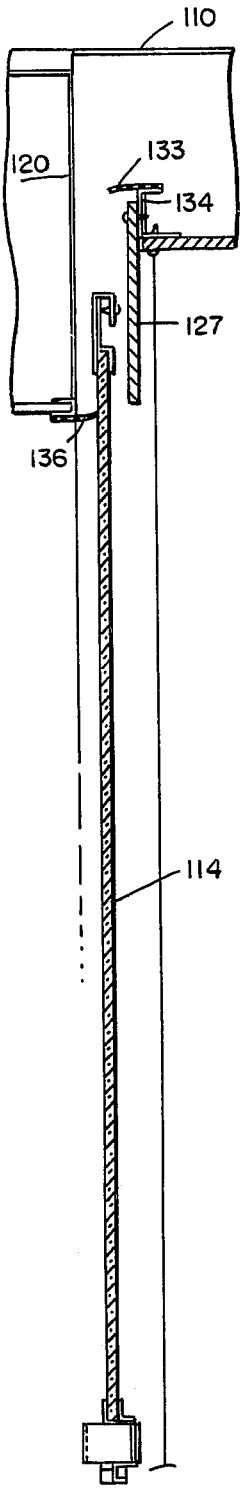
FIG. 6 is a view similar to FIG. 5 showing the sash partially raised.
Figure 7:
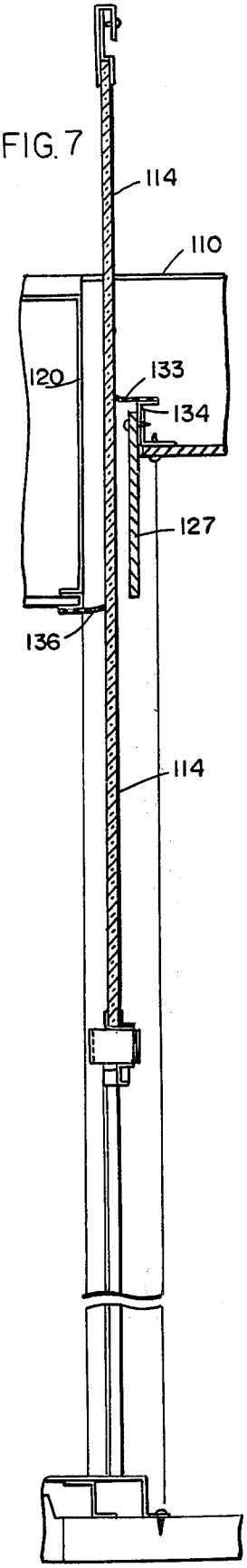
FIG. 7 is a view similar to FIGS. 5 and 6 showing the sash fully raised.

The seals illustrated in FIGS. 1–4 may produce a noise when they spring into contact with the opposed wall as the sash is lowered below each seal or when they reverse direction. In some cases this noise might be objectionable. Further, the seals may create a drag on the sash which some users might find undesirable. FIGS. 5–7 illustrate another embodiment of the seals which eliminate these possible objections while still sealing the sash clearance opening when the sash is raised. The rear seal of this embodiment also provides the important wiping action for the rear surface of the sash.

The fume hood 110 is identical to the fume hood 10 previously described and includes an auxiliary air chamber 118 having a rear wall 120 and a working chamber with front wall 127. The two walls define a sash clearance opening 126 therebetween. An upper or rear seal 133 is secured to an angle 134 on the front wall 127, and a lower or front seal 136 is secured to a mounting angle 137 for the air grille.

The front and rear seals are advantageously made of flexible and resilient material, and may be made of the same material and secured in the same way as the seals 33 and 36. The primary difference between the seals 133 and 136 and the seals 33 and 36 is that the former seals do not extend all the way across the sash clearance opening when the sash is in the lowered position as illustrated in FIG. 5. The seals therefore do not provide a sealing action when the sash is lowered, but they may inhibit to some extent air leakage through the sash clearance opening.

The front seal 136 has a width, i.e., a dimension extending toward the working chamber, sufficient to contact the front surface of the sash 114 as the sash is raised above the front seal, as illustrated in FIG. 6. The front seal extends for substantially the full length of the sash clearance opening between the sides of the fume hood, and when the sash is raised above the front seal, the seal sealingly engages the sash and prevents loss of auxiliary air through the sash clearance opening and short circuiting of auxiliary air over the top of the sash and into the working chamber.

The width of the rear seal 133 is sufficient to sealingly engage the rear surface of the sash when the top of the sash is raised above the rear seal as illustrated in FIG. 7. The length of the rear seal 133 extends for substantially the entire length of the sash clearance opening, and when the top of the sash is raised above the rear seal, the rear seal prevents room air from entering the working chamber through the sash clearance opening at the roof of the hood. The rear seal also wipes the rear surface of the sash free of any clinging fumes as the sash is raised and prevents such clinging fumes or fumes which may be drawn upwardly adjacent the sash from escaping from the working chamber into the laboratory.

Although the seals 133 and 136 are wide enough to sealingly engage the rear and front surfaces of the sash, they are not wide enough to cause objectionable flopping noise when the direction of movement of the sash is reversed. The resilient seals will maintain sealing contact with the sash when the movement of the sash is reversed, and the seals will reverse to some extent but in a substantially noiseless manner. The narrower seals 133 and 136 also create less drag on the sash than the wider seals 33 and 36.

While we have described the preferred embodiments of the seals as having widths sufficient to sealingly engage the sash, leakage of air through the sash clearance opening can be substantially prevented even if the seals do not contact the sash but extend adjacent to the sash. Although a slight space might remain between each seal and the sash surface, leakage of air would be substantially inhibited. Also, the important wiping action of the rear seal can be obtained even if the rear seal does not contact the rear surface of the sash. Substantially all of the fumes will be retained by the seal even if there is a slight spacing between the rear seal and the sash, but for optimum wiping action, the rear seal should contact the sash.

At times a fume hood user might not be too concerned about preventing short circuiting or leakage of auxiliary air through the sash clearance opening. For example, many fume hoods are not equipped with an auxiliary air chamber. In such cases, the fume hood could be equipped only with the rear seal means to provide the wiping action and to seal the sash clearance opening against leakage of room air into the working chamber.

On the other hand, on a fume hood which is equipped with an auxiliary air chamber, only a front seal means might be used. This seal means would prevent loss of auxiliary air through the sash clearance opening at the roof of the hood.

Although the specific embodiments of the front and rear seal means described are formed from a flexible and resilient material, other types of seal means can be used. For example, either or both of the front seals can be provided by an elongated brush which extends for the length of the sash clearance opening and which is provided with bristles or the like which contact the sash as it is raised.

While in the foregoing specification detailed descriptions of specific embodiments of the invention were set forth for the purpose of illustration, it is to be understood that many of the details herein given may be varied considerably by those skilled in the art without departing from the spirit and scope of the invention.

We claim:

1. In a fume hood having a frame, the frame including a pair of spaced-apart walls providing a sash clearance opening, and a sash having front and rear surfaces and being slidably mounted in the frame for movement within the sash clearance opening between raised and lowered positions, the improvement comprising seal means mounted on one of the pair of spaced-apart walls and extending into the sash clearance opening, the seal means extending toward the sash when the sash is raised whereby the clearance opening between the sash and said one wall is substantially sealed.

2. The structure of claim 1 in which the seal means has a width sufficient to extend across the sash clearance opening to engage the other wall of the pair of spaced-apart walls when the top of the sash is below the seal means whereby the sash clearance opening is substantially sealed when the sash is in the lowered position.

3. The structure of claim 1 in which the seal means is formed from an elongated strip of flexible and resilient material.

4. The structure of claim 1 in which the seal means has a width sufficient to extend into engagement with the front surface of the sash when the sash is raised.

5. The structure of claim 1 in which the seal means has a width sufficient to extend in engagement with the rear surface of the sash when the sash is raised.

6. In a fume hood having a frame and a sash having front and rear surfaces, the frame including a first wall spaced forwardly from the front surface of the sash and a second wall spaced rearwardly from the rear surface of the sash to provide a sash clearance opening, the sash being mounted in the frame for movement within the sash clearance opening between raised and lowered positions, the improvement comprising front seal means mounted on the first wall and extending toward the front surface of the sash when the sash is raised whereby the sash clearance opening between the sash and the first wall is substantially sealed when the sash is raised, and rear seal means mounted on the second wall and extending toward the rear surface of the sash when the sash is raised whereby the sash clearance opening between the sash and the second wall is substantially sealed when the sash is raised.

7. The structure of claim 6 in which the front seal means has a width sufficient to extend into engagement with the front surface of the sash when the sash is raised.

8. The structure of claim 6 in which the rear seal means has a width sufficient to extend into engagement with the rear surface of the sash when the sash is raised.

9. The structure of claim 6 in which the front seal means has a width sufficient to extend into engagement with the front surface of the sash when the sash is raised and the rear seal means has a width sufficient to extend into engagement with the rear surface of the sash when the sash is raised.

10. The structure of claim 6 in which the rear seal means has a width sufficient to extend across the sash clearance opening to engage the first wall when the top of the sash is below the rear seal means whereby the sash clearance opening is substantially sealed when the sash is in the lowered position.

11. The structure of claim 6 in which the front seal means has a width sufficient to extend across the sash clearance opening to engage the second wall when the top of the sash is below the front means whereby the sash clearance opening is substantially sealed when the sash is in the lowered position.

12. The structure of claim 6 in which the front seal means is formed from an elongated strip of flexible and resilient material.

13. The structure of claim 6 in which the rear seal means is formed from an elongated strip of flexible and resilient material.

14. The structure of claim 6 in which each of the seal means is formed from a flat strip of flexible and resilient material, the flexibility of each seal means being sufficient to permit the contour of the seal means to reverse as the sash moves from the raised position to the lowered position.

15. The structure of claim 6 in which the front seal means is mounted below the first seal means.

16. The structure of claim 6 in which the fume hood includes an auxiliary air chamber, said first wall being part of the auxiliary air chamber.

17. The structure of claim 6 in which the front seal means has a width sufficient to extend across the sash clearance opening to engage the second wall when the top of the sash is below the front seal means and the rear seal means has a width sufficient to extend across the sash clearance opening to engage the first wall when the top of the sash is below the rear seal means whereby the sash clearance opening is substantially sealed when the sash is in the lowered position.

* * * * *

UNITED STATES PATENT AND TRADEMARK OFFICE

CERTIFICATE OF CORRECTION

PATENT NO. : 3,942,421

DATED : March 9, 1976

INVENTOR(S) : Richard C. Tringali; Michael Turko

It is certified that error appears in the above-identified patent and that said Letters Patent are hereby corrected as shown below:

In column 5, line 49, "in" should be --into--.

In column 6, line 30, --seal-- should be inserted before "means".

Signed and Sealed this

Thirteenth Day of July 1976

[SEAL]

*Attest:*

RUTH C. MASON
*Attesting Officer*

C. MARSHALL DANN
*Commissioner of Patents and Trademarks*